United States Patent [19]

Sato

[11] Patent Number: 4,718,460

[45] Date of Patent: Jan. 12, 1988

[54] BINDING TOOL

[75] Inventor: Shinichi Sato, Tokyo, Japan

[73] Assignee: Satogosei Co., Ltd., Tokyo, Japan

[21] Appl. No.: 32,824

[22] Filed: Apr. 2, 1987

Related U.S. Application Data

[63] Continuation of Ser. No. 779,952, Sep. 20, 1985, abandoned.

[30] Foreign Application Priority Data

Oct. 12, 1984 [JP] Japan ..... 59-213583

[51] Int. Cl.[4] ..... B21F 9/02

[52] U.S. Cl. ..... 140/93.2; 140/123.6

[58] Field of Search ..... 140/93.2, 123.6

[56] References Cited

U.S. PATENT DOCUMENTS

| | | | |
|---|---|---|---|
| 3,661,187 | 7/1969 | Caveneg et al. | 140/123.6 |
| 3,782,426 | 1/1974 | Morgan et al. | 140/123.6 |
| 3,830,263 | 8/1974 | Benfer | 140/93.2 |
| 4,410,019 | 10/1983 | Suzuki | 140/123.6 |

FOREIGN PATENT DOCUMENTS

| | | |
|---|---|---|
| 16833 | 9/1966 | Japan . |
| 49-8397 | 1/1974 | Japan . |
| 204810 | 12/1982 | Japan . |
| 2099530 | 9/1984 | United Kingdom . |

*Primary Examiner*—Robert P. Olszewski
*Assistant Examiner*—Robert Showalter
*Attorney, Agent, or Firm*—Mason, Fenwick & Lawrence

[57] ABSTRACT

A binding tool including a holding and tensioning mechanism, a cutter arm having two operating parts, a driving device for driving the mechanism and a returning force giving mechanism. The tool comprises a handle connected with a handle connecting link operating the driving device and having a cutting operation end in the head; the driving device including a first toggle link, a second toggle link, a slider connecting link and a toggle slider, the slider connecting link being borne at the rear end of the slider and operating the slider against the returning force mechanism, a stopper roller borne by the toggle slider, a sector slider being in contact with and capable of being pushed down by the toggle slider, and a tension roller pivoted to the lower part of the toggle slider, regulated in the downward movement by a regulating guide, and being operated through the handle connecting link contacted with the stopper roller; a switching device having a locking projection on a switching lever borne coaxially with the tension roller and capable of switching and disposing the locking projection in an engaging or disengaging position with the operating part at the rear end of the cutter arm.

1 Claim, 10 Drawing Figures

BINDING TOOL

This application is a continuation of application Ser. No. 779,952, filed 9/20/85, now abandoned.

FIELD OF THE INVENTION

This invention relates to a binding tool for fastening and cutting binding bands.

The binding tool of the present invention is used to secure the binding of articles with such binding bands made of a plastic such as plastic cable ties used to bind electric wires and to cut and remove excess free ends of bands.

BACKGROUND OF THE INVENTION

Binding tools for bands for binding electric wires and other materials are already disclosed, for example, in the gazettes of Japanese Patent Publication No. 16833/1966 and Japanese Patent Laid Open Nos. 8397/1974 and 204810/1982.

In the binding tool for bound bundles disclosed in Japanese Patent Application No. 16833/1966, a device for preventing driving movement of a movable shearing blade is provided so that, when a predetermined tension is produced, substantially instantaneously, the controlling force will be reduced from the driving device and the driving device will be freed for the band cutting operation. In the binding band cutter for electric wires and the like disclosed in Japanese Patent Laid Open No. 8397/1974, after a predetermined tension is reached, a coil spring will be compressed and an operating piece will act on a blade rod. In the binding tool disclosed in Jananese Patent Laid Open No. 204810/1982 (corresponding to U.S. Pat. No. 4,410,019), after a sliding member and push-up member are disengaged with each other, a push-down member will act on a rocking member and thus, after the tension of the band is relaxed, the band will be cut.

In these conventional binding tools, after the binding band is tensioned and fastened, the band will be cut while the free end of the band is under tension or after the tension is relaxed.

When cutting the free end of the band under tension occurs, the cut end of the band will be contained within the locking head of the binding band. Therein, the cut end will not be exposed and the appearance will be good but, on the other hand, unless the tension is set carefully, the band will be likely to be removed. On the other hand, when the cutting occurs after relaxing the tension, the cut end will remain outside the locking head and the problem of the appearance will remain but, by the relaxing effect, the security of the binding can be expected. Thus, there are merits and demerits. Depending on the operating state, the cutting whether under the tension or after relaxing the tension is selected by the user.

For the above mentioned reasons, it is desired to enable both containing the cut end of the binding band within the locking head and leaving the cut end outside the locking head. However, as mentioned above, the tools of the conventional type only have one function of either containing the cut end within the locked head or leaving it outside the locked head.

In order to meet with one binding tool the requirement of being able to freely select the above mentioned two kinds of functions, the present invention is to provide a binding tool having both functions of cutting the free end of a band under a tension and after relaxing the tension.

SUMMARY OF THE INVENTION

The present invention is a binding tool for fastening and cutting off a band having a holding and tensioning means and cutting means for binding bands so that, after the band reaches a set tension, the cutting means will operate and a returning force will be given, which comprises an element operating the cutting means when the band reaches a set tension and an element operating the cutting means under a reduced tension after the tension of the band having reached the set tension is relaxed, and means for switching from one to the other.

DETAILED DESCRIPTION OF THE INVENTION

The present invention will be explained more particularly in the following with reference to the drawings.

Figure 1:
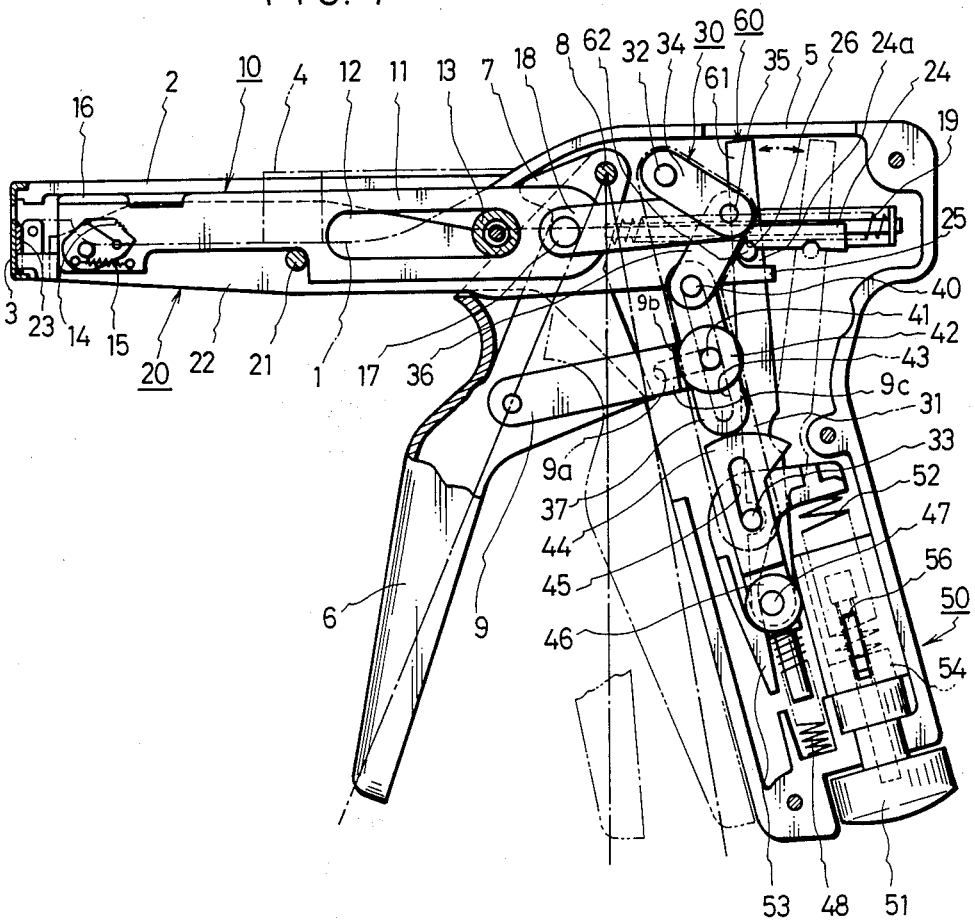
FIG. 1 is an elevation of a binding tool with the front surface plate of the case removed.

A binding tool formed generally to be of a pistol-type is shown in FIG. 1 with a front surface plate 1 of the case removed and has a rear surface plate 2 of the case, a cuttercover 3, a spring out cover 4 and a handle 6 pivoted on a shaft 8. The cover 4 has a switching operation access hole 5 in the upper part.

The handle 6 has a cut producing end 7 in the upperpart, it is biased by a compression spring 19 and has a handle connecting link 9 pivoted to it.

A slide 11 forming the part of a holding and tensioning means 10 has a guide groove 12 through which a stop member 13 is inserted, and is supported for restricted forward and rearward movement by the stop member 13 coupled to the case and by a shaft 21. A pawl 14 is energized by a spring 15 connected to the forward end part of slide 11, a holding member 16 is provided opposite the pawl 14.

A cutter arm 22 forming the part of a cutting means 20 is connected to the shaft 21 and has a cutter 23 in the forward end part. An arm returning part 24 having locking recesses 26 and 27 and an arm operating part 25 are formed in the rear end part of the cutter arm 22. An incised hole 24*a* of about the diameter of the locking recess 26 or a little larger is formed between the arm returning part 24 and arm operating part 25. The cutter arm has the above mentioned arm operating part 25 and a second operating part corresponding to the cut producing end 7 of the above mentioned handle 6.

Figure 2:
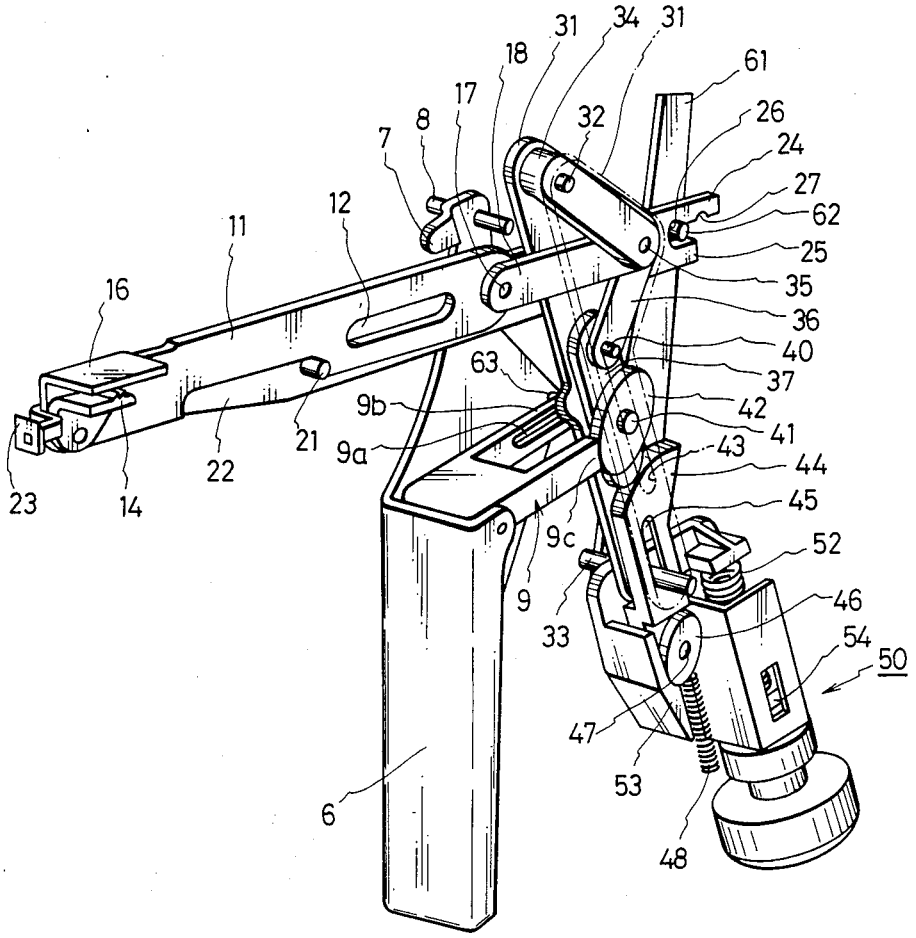
FIG. 2 is a perspective view showing an essential part of the binding tool.

A driving part 30 having a toggle mechanism is provided with a pair of supporting arms 31 (the supporting arm on the front surface is shown by broken lines in FIGS. 1 and 2), pivoted on a shaft 33 fixed to the case and connected with each other through a shaft 32. A first toggle link 34 is pivoted on the shaft 32 between the supporting arms 31, a second toggle link 36 is pivotally connected to the first toggle link 34 through a shaft 35, and a slide conncting link 18 is connected between shaft 35 and slide 11. A toggle slide 37 is connected to the second toggle link 36 through a shaft 40, a stop roller 42 is rotatably fitted to a shaft 41 of the toggle slide 37. A sector slide 44 has an arcuated curved surface in contact with an arcuate surface at the lower end of the toggle slide 37 and has a guide groove 45 through which the above mentioned shaft 33 is inserted. A tension roller 46 is pivoted by shaft 47 to the lower part of the sector slide and a spring 48 biases the sector slide 44. The above mentioned shafts 40 and 41 are movably supported in a guide groove 43 provided in the supporting arm 31 in the upper part.

In the thus formed driving part 30, the slide connecting link 18 is borne by the shaft 17 in the rear side part of the slider.

The handle connecting link 9 has a part 9*b* provided with a guide groove 9*a* and a shorter contact part 9*c* with the stop roller 42. A shaft 63 (FIG. 2) fixed to the lower supporting arm 31 in a position concentric with the shaft 41 before operating the handle is inserted through the above mentioned guide groove 9*a*.

Therefore, when the handle 6 is moved, the contact part 9*c* will contact the stop roller 42 to operate the driving part 30 and, even if the stop roller 42 moves downward due to the later described action, the contact part 9*c* will be regulated by the shaft 63 in its downward movement and therefore the contact of the stop roller 42 with the contact part 9*c* will be released.

The tension roller 46 will be regulated in its downward movement by a regulating guide 53 pivoted on the shaft 33. The regulating guide 53 will be biased by a compression spring 52 supported by a tension nut 54 and the regulating pressure of the regulating guide will be regulated through a tension setting device 50 having a tension adjusting screw 56 by the rotation of an adjusting knob 51.

A switch device 60 is formed of a switching lever 61 provided with a locking projection 62, the switch lever 61 is pivoted at the lower end to the above mentioned shaft 47 so that, by operating the switch lever 61 through the access hole 5, the locking projection 62 can be locked in the locking hole 26 or 27 of the cutter arm 22.

The binding method will be explained in the following with reference to FIGS. 2 to 5 by using the binding tool formed as described above.

Figure 3A:
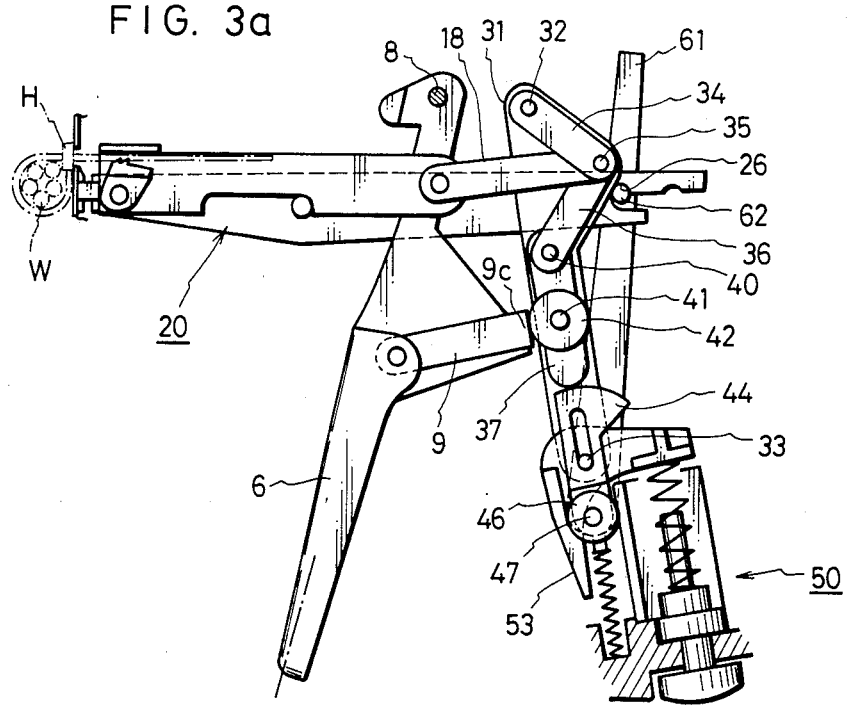
FIGS. 3*a, b* and 4*a–c* are explanatory views of the operating mechanism in respective switching positions.

First of all, the case of cutting a binding band as tensioned shall be described with reference to FIGS. 3*a* and 3*b*. In this case, the switch lever 61 is locked in the locking recess 26.

After winding objects W to be bound, the free end of a band is inserted through a locking head H, and inserted from the tip of the binding tool the free end of a band is held and tensioned between the pawl 14 and holding member 16 as the slide 11 moves rearward.

When the handle 6 is pulled, the contact part 9*c* of the handle connecting link 9 will push the stop roller 42 and the driving part 30 will rotate around the shaft 33.

The toggle link will retreat the slide 11 through the slider connecting link 18 and the held free end of the band will be tensioned. By the way, when the handle is released, the band will engage within the head against the force in the reverse direction, the pawl 14 will release the holding of the band with the returning force of the spring 19 and the slide will return to the original positon.

Therefore, by repeating the handle operation, the band can be tensioned to a set tension. On the other hand, in the tension setting device 50, when the limit of the set tension adjusted by the tension adjusting screw 56 is reached, the toggle links 34 and 36 will gradually open, the toggle slide 37 will be pushed downward through the shaft 40 and therefore the tension roller 46 will be pushed downward through the sector slide 44. The tension roller 46 will push the regulating guide 53 downward and will balance with the controlling force of the compression spring 52 (FIG. 3).

However, when a pressing force larger than the set pressure is applied, the tension roller 46 will push out the regulating guide 53 in the lateral direction, the regulating guide will rotate around the shaft 33 and the tension roller 46 will move downward.

Therefore, the switch lever 61 pivoted to the shaft 47 will move downward.

Figure 3B:
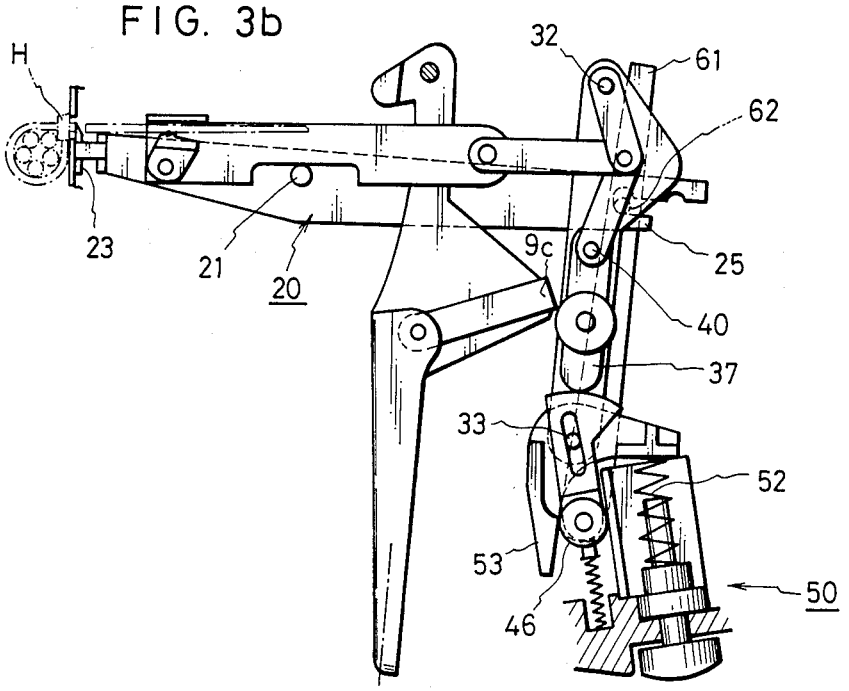

As the locking projection 62 is locked in the locking recess 26 of the cutter arm returning piece 24, the cutter arm operating part 25 will be pushed down, the cutter arm 22 will rotate around the shaft 21 and the cutter 23 will cut the band (FIG. 3*b*).

Figure 5:
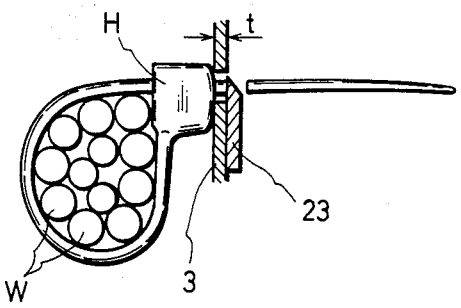
FIG. 5 is an explanatory view of a binding band as cut.
Figure 6:
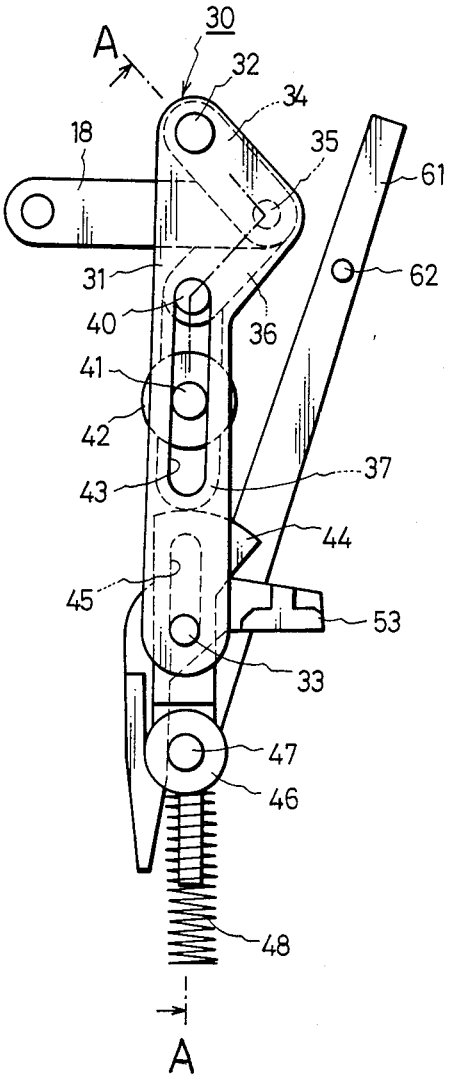
FIG. 6 is in elevational view of the driving part 30.
Figure 7:
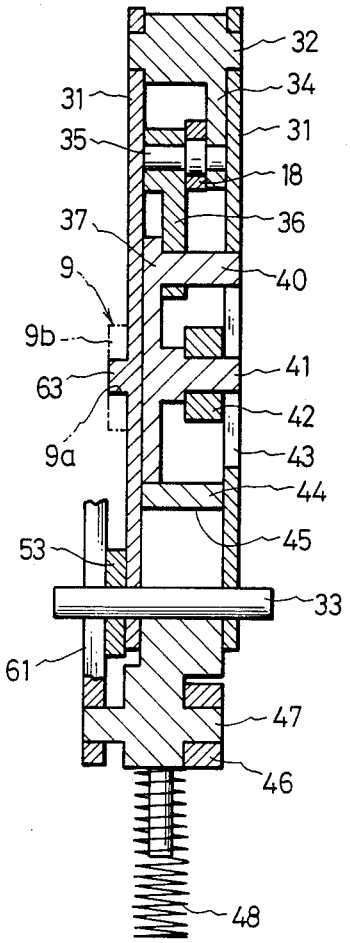
FIG. 7 is a sectional view of FIG. 6 along line A—A.

Therefore, as the band will be cut under a tension, as shown in FIG. 5, the cut end projected by the thickness of the cutter cover 3 when cut will be locked while entering the locking head H by the returning action of the objects W wound and the returning action of the surrounding band and will be contained within the locking head H.

However, in this case, as understood in FIG. 3*b*, the shaft 35 will move slightly forward against the slide 11 moving rearward and therfore, even if the driving part 30 moves rearward, the slide 11 will stop or nearly stop, that much the tension of the binding band will be a little relieved and the positivity of the binding will be assured.

The operation of the binding band moving from the relaxing to the cutting shall be explained in the following.

Figure 4A:
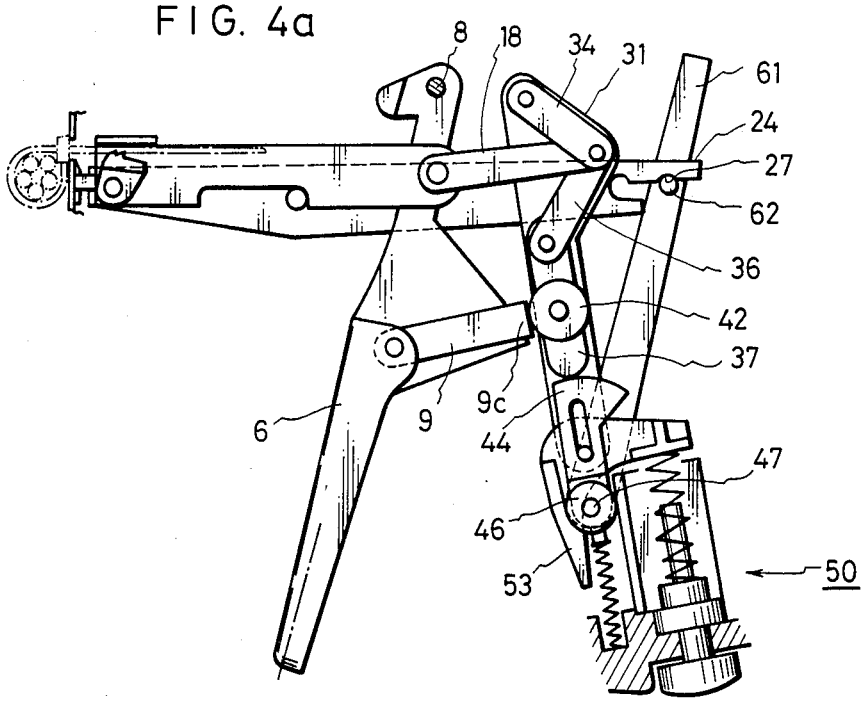
Figure 4B:
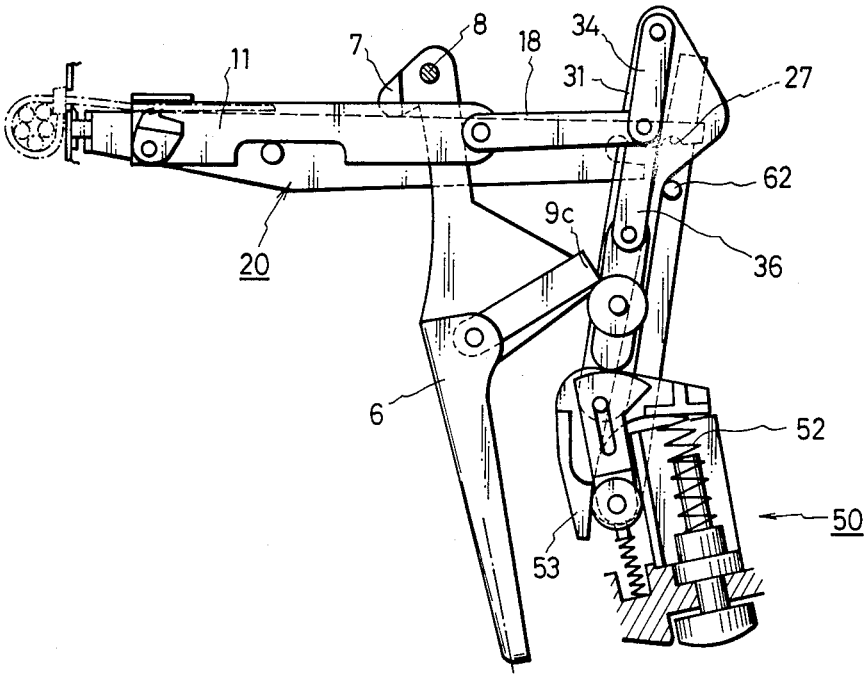

When the switch lever is switched to the position of FIG. 4, the driving part will operate the same as is mentioned above with the handle operation (FIG. 4*a*) but, even if the tension roller 46 pushes out the regulating guide 53 in the lateral direction and moves it downward and, with it, the switch lever 61 moves downward, the locking projection 62 of the switch device locked in the locking recess 27 at the rear end of the cutter arm will not contact with the operating part 25 of the cutter arm (FIG. 4*b*).

When in this state, the toggle mechanism will have moved the slide 11 reversely leftward so much with the tension of the band that the once tensioned free end of the band will be relaxed and the band will be locked within the locking head H before being cut.

Figure 4C:
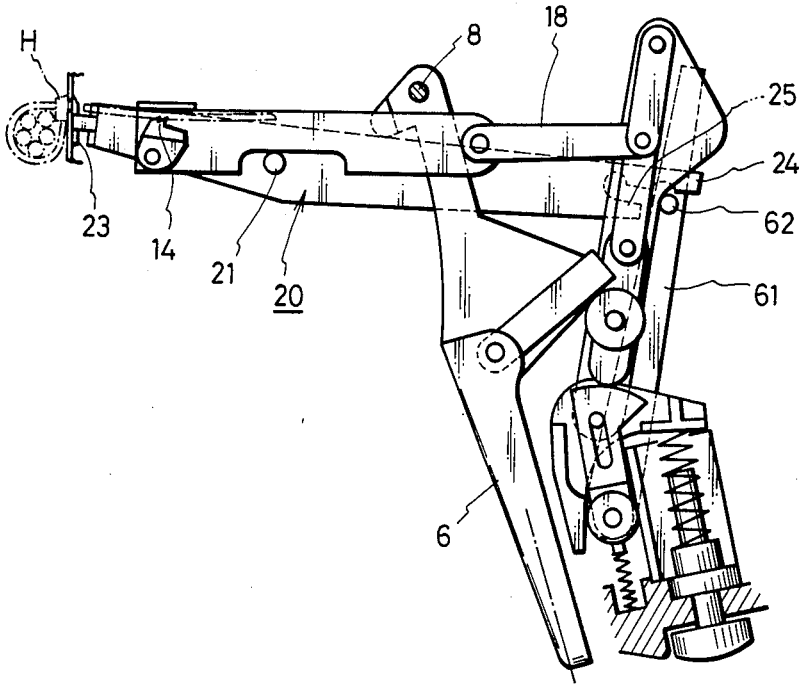

When the handle is further pulled, the cutter arm 22 will be rotated around the shaft 21 by the cutting operation end 7 of the handle head and the band will be able to be cut (FIG. 4*c*).

Therefore, as shown in FIG. 5, the cut binding band will remain outside the locking head H by the thickness t of the cutter cover 3.

It can be known that, irrespective of the position of the switch device, after the band is cut, if the handle is released, the respective mechanisms will be returned to the original positions by the actions of the springs 48, 19 and 52.

In the binding tool of the present invention, with merely a set of a holding mechanism and cutting mechanism, by a simple switching operation, it can be selected to cut the free end of a band whether under a tension or after the tension is relaxed and, by the judgment of the worker, in response to the objects to be worked, it can be freely adapted whether to contain the cut end within the locking head or to leave it outside the locking head. Thus, it is a combined tool which can develop both of the functions.

I claim:

1. A binding tool comprising a holding and tensioning means including a movable slide having a rear end part and a front end part and having a binding band holding part in the front end part, a driving part adjacent the rear end part of said slide including a toggle mechanism having at an input side thereof a slide connecting link connected to the rear end part of said slide and including at an output side thereof a toggle slide and arranged so as to push down the toggle slide when driven, the driving part having a rotary fulcrum portion below said toggle mechanism, a sector slide movable downwardly in the rotary fulcrum portion of said driving part and operated by said toggle slide, a switch lever pivoted at a lower end thereof to said sector slide and having a locking projection in an upper part thereof, a cutter arm having at one end a cut producing end and in the other end two operating parts disengageable with said locking projection and rockably pivoted centrally of the arm, a handle having in an upper part thereof a cut producing end operating said cutter arm for cutting and a handle connecting link pivoted at one end in the middle of said handle and connected at the other end with said driving part disengageably with the operation of the toggle slide, whereby when the locking projection is engaged with one of said two operating parts the cutter arm is activated to cut the band under a predetermined tension and when the locking projection is disengaged the cutter arm is activated by the handle to cut the band under a relaxed tension after the band is related.

* * * * *